United States Patent [19]

Hirai

[11] 3,965,325

[45] June 22, 1976

[54] MICROWAVE OVEN

[75] Inventor: Kazumi Hirai, Nabari, Japan

[73] Assignee: Matsushita Electric Industrial Co., Ltd., Kadoma, Japan

[22] Filed: Mar. 24, 1975

[21] Appl. No.: 561,653

[30] Foreign Application Priority Data

Mar. 23, 1974 Japan ..... 49-33516
Aug. 14, 1974 Japan ..... 49-97844

[52] U.S. Cl. ..... 219/10.55 R; 219/10.55 F
[51] Int. Cl.[2] ..... H05B 9/06
[58] Field of Search ..... 219/10.55 F, 10.55 R, 219/10.55 A

[56] References Cited

UNITED STATES PATENTS

| | | | |
|---|---|---|---|
| 3,364,332 | 1/1968 | Reftmark | 219/10.55 F |
| 3,370,145 | 2/1968 | Malmquist | 219/10.55 F |
| 3,626,136 | 12/1971 | Funahashi | 219/10.55 F |
| 3,783,219 | 1/1974 | Tateda | 219/10.55 D |

FOREIGN PATENTS OR APPLICATIONS

| | | | |
|---|---|---|---|
| 47,232 | 1/1972 | Japan | 219/10.55 F |

*Primary Examiner*—Arthur T. Grimley
*Attorney, Agent, or Firm*—Wenderoth, Lind & Ponack

[57] ABSTRACT

A microwave oven in which the oven chamber is defined by upper and lower portions each generally triangular in section and which is provided with efficient microwave reflecting and distributing arrangements. The lower portion is defined by a main casing and the upper portion, which includes the oven chamber front and top walls, is defined by a concave portion in a door assembly which is hinged along a rear edge portion and may be pivoted upwards to open positions and downwards to a closed position. When in a completely opened position the door assembly exposes the top and front of the oven, whereby insertion or removal of food may be effected through the top or front of the oven, and the oven permits convenient use when placed at different levels.

8 Claims, 5 Drawing Figures

MICROWAVE OVEN

Figure 1:
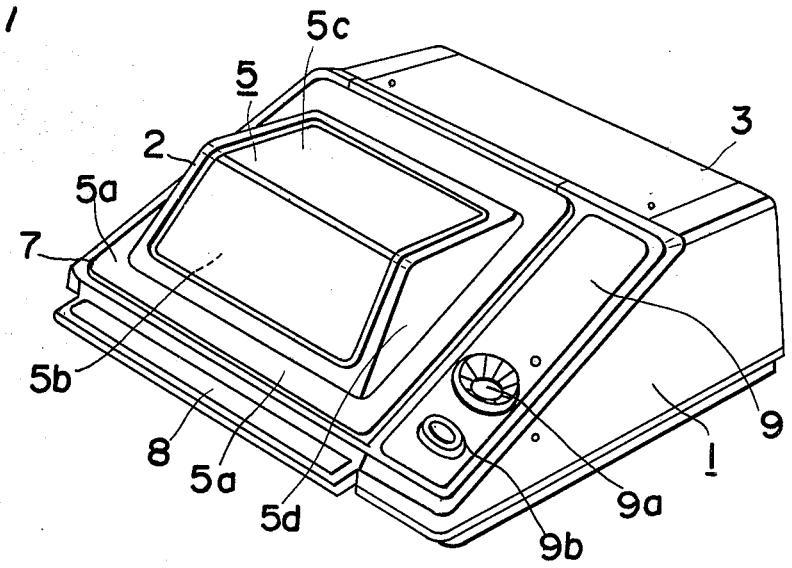

The present invention relates to a microwave oven and more particularly to a microwave oven which has a compact and economical structure, and which may be used without inconvenience when located in a restricted space or at different levels.

There is known and commonly employed a type of oven which is generally termed a microwave oven and which makes use of the heating effects of microwaves, produced, for example, by a magnetron located in a housing adjacent to a casing defining the oven chamber, and supplied into the oven chamber. Problems associated with microwave ovens are comparatively high cost, and noisy operation due to vibration of oven parts, particularly oven chamber walls, caused by leakage of magnetic flux from a power transformer or similar means for supplying power to the magnetron. Another problem associated with this type of oven is that of avoiding concentration of microwaves in only one or in restricted portions of the oven chamber, since this is liable to result in incomplete or inefficient heating of food placed in the oven. One method of effecting even distribution is to provide a fan which has blades made of a material able to reflect microwaves. However in conventional means, operation of such a fan requires further expenditure of electricity. It is accordingly a desideratum to provide a microwave oven which, while making optimum use of space, avoids exposing oven parts, particularly oven chamber walls, to the effects of leakage of magnetic flux from a power supply, and also ensures even distribution of microwaves throughout the oven chamber without incurring additional cost.

Microwave ovens are well suited to employment as portable ovens, but conventional microwave ovens present a further problem in this respect since they are generally provided either with a door which is hinged along a side and swings open sideways, or with a door which is hinged along a bottom edge and swings open downwards, in either case the door constituting the front wall of an oven. This type of construction has various disadvantages. One disadvantage is that it becomes difficult to use the oven in a comparatively restricted space since allowance must be made to permit the door to swing open. Another disadvantage is that a portable oven is inevitably subjected to a certain amount of jolting or other action liable to result in imperfect fit of moving parts of the oven, and the principal moving part of the oven is the door, which must be retained in a closed position solely by catch means, since its weight does not act to retain it in a closed position. In other words, in conventional means there is no naturally acting force which tends to counter any imperfection of fitting of a door after a certain amount of displacement of the oven. This is particularly disadvantageous for an oven employing microwaves as the mode of heating, not only from the point of view of poor economy due to lost heat, but also because of the possibility of leakage of microwaves which can be hazardous to a person using the oven. Another disadvantage, which relates to convenience of use of an oven, is that the support that may be available for a portable oven can be by no means guaranteed to be such that the oven is at an optimum level for use. In particular, if the oven can only be supported on the ground, or at a low level, it becomes extremely difficult to insert or remove food into or from the oven or to inspect food therein.

It is accordingly a principal object of the present invention to provide a microwave oven having a compact and economical construction, and having a door which opens upwards and permits the oven to be used in a comparatively restricted space, and whose weight acts to aid latch or other devices when the door is in a closed position, and which defines a broad sealing area permitting effective sealing against leakage of microwaves.

It is a further object of the invention to provide a microwave oven which is simultaneously openable at the front and top, whereby food may be inserted into he oven from above or from the front of the oven, and the oven may be used without inconvenience while located at any one of different levels.

It is another object of the invention to provide a microwave oven wherein microwaves are distributed evenly by a fan means not requiring supplementary expenditure of electricity.

It is still further object of the invention to provide a microwave oven wherein effects of leakage of magnetic flux from a power supply means are minimized.

In achieving these and other objects there is provided, according to the present invention, a microwave oven wherein the oven chamber is defined by upper and lower portions which are both generally triangular in section, the lower portion comprising the base and rear walls and lower half of the side walls of the oven chamber and being defined by an oven main casing, and the upper portion comprising the front and top walls and upper half of the side walls of the oven chamber and being formed as a concave portion in an oven door assembly which also comprises a broad rim which may fit in flat contact against a corrrespondingly dimensioned border provided in the main casing around the open side of the chamber lower portion, and which when in a closed position lies on an inclined plane sloping upwards from front to rear of the oven, the weight of the door assembly thus acting downwards and assisting latch means to retain the door assembly in a closed position, and the broad rim portion thereof permitting adequate provision of microwave sealing means. The door assembly is hinged at a rear edge portion thereof and may be pivoted upwards to pening positions or downwards to a closed position. The door assembly does not project to the front or side of the oven during opening or closing, and the oven is therefore employable in a comparatively small space. Also, since the door assembly defines the front and top walls of the oven chamber, when the door assembly is in a completely open position, food may be inserted into the oven, or removed therefrom, from above or from the front of the oven, which is thus employable with equal convenience at a variety of levels or locations. The front and top walls of the oven chamber are provided at a suitable angle to one another to ensure that there is no collision with an object placed in the oven when the door assembly is closed, and also to contribute to even distribution of microwaves supplied into the oven chamber. At the rear of the main casing there is provided a housing containing a heating assembly including a magnetron, and a high voltage transformer, which supplies power to the magnetron, and is located in a rear corner portion of the housing whereby leakage flux can have only minimum effect on chamber wall portions of the oven. Microwaves produced by the magnetron are directed into a rear portion of the main casing and into contact with microwave stirrer means, which is referred to as a stirrer fan or a fan hereinafter. The stirrer fan is caused to rotate by air which is supplied into the heating assembly housing to cool the magnetron, provision of a separate fan motor thus being unnecessary, and microwaves are directed thereby into the oven chamber. The invention thus provides a sturdy, economical microwave oven which presents practically no restrictions on location thereof, since it has minimum space requirements and may be used with equal convenience at high or low levels.

Figure 2:
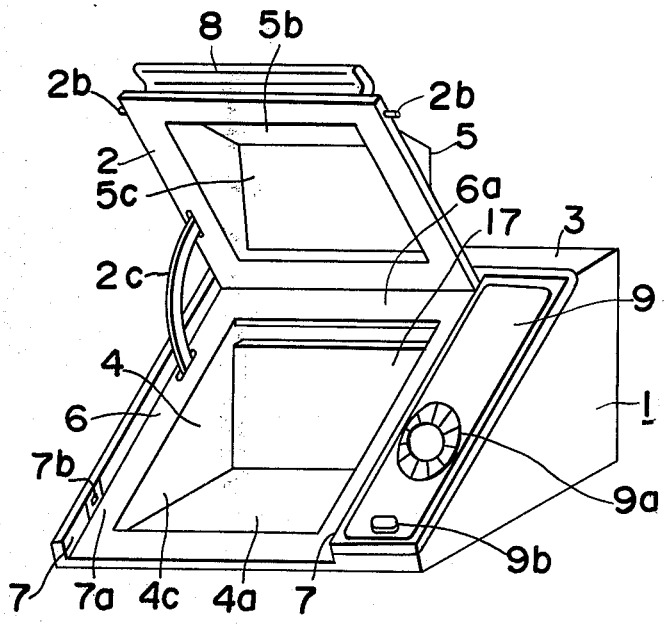
Figure 5:
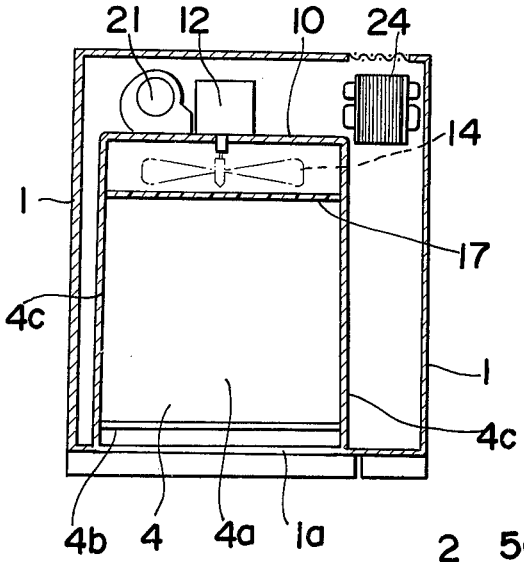
Figure 3:
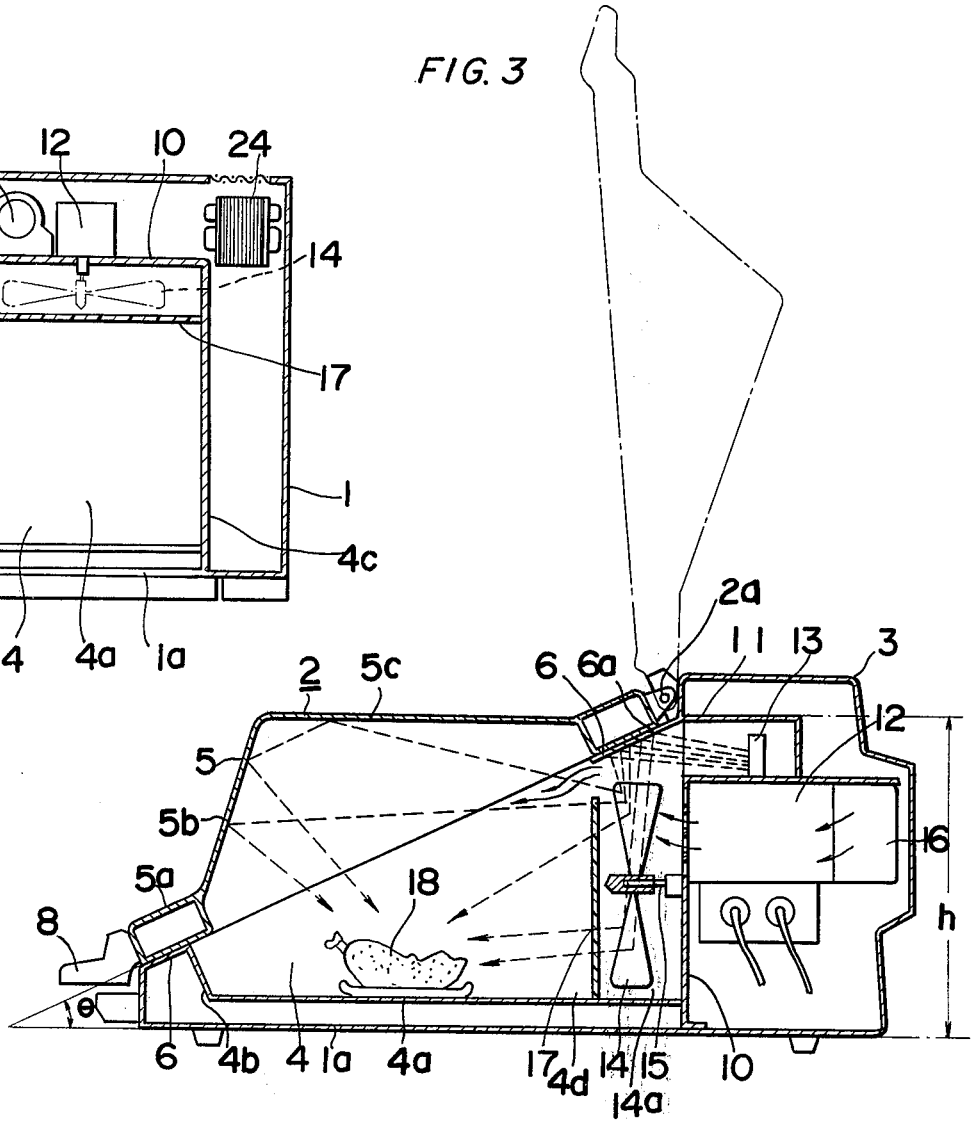
Figure 4:
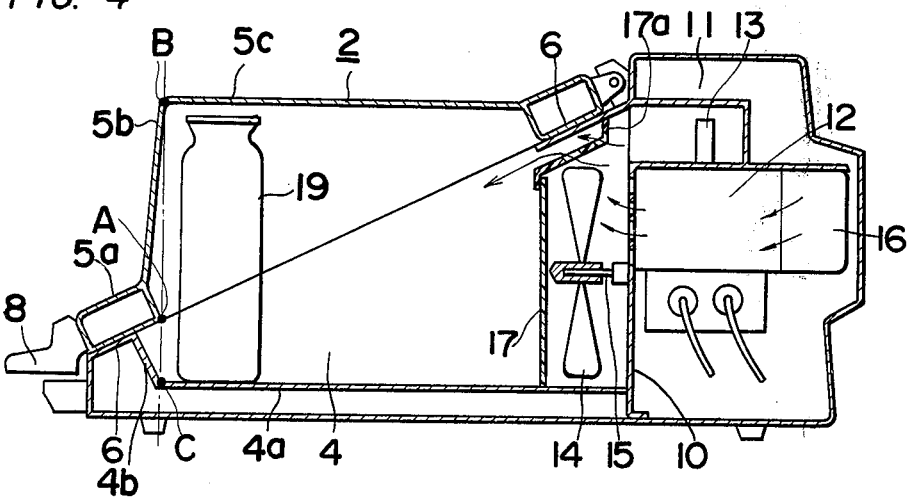

A better understanding of the present invention may be had from the following full description of one preferred embodiment thereof when read in reference to the attached drawings, in which like numbers refer to like parts, and FIG. 1 is a perspective view of a microwave oven according to the invention, FIG. 2 is a perspective view showing the oven of FIG. 1 with a door assembly in an open position, FIG. 3 is a front to rear cross-sectional view of the oven of FIG. 1, FIG. 4 is a similar view to FIG. 3, but particularly shows a modification of a view window for a door assembly, and FIG. 5 is a horizontal cross-sectional view of the oven of FIG. 1 showing disposition of heating assembly elements.

Referring to FIGS. 1 through 3, there is shown a microwave oven comprising three main portions which are a main casing 1, which defines the lower portion of the oven chamber, a door assembly 2, which is moveable to open or close the oven and also defines the upper portion of the oven chamber, and a heating assembly housing 3, which has a generally rectangular box shape and is provided in fixed or integral attachment to the rear of the main casing 1. The main casing 1 preferably has a double wall structure and comprises inner walls which are suitably made of steel plate or similar material and define an oven chamber lower portion 4, these inner wall including a horizontal base 4*a* spaced from the bottom plate 1*a* of the casing 1 and vertical side walls 4*c* which have lower edges in integral attachment to left and right sides of the base 4*a*, i.e., left and right sides thereof as seen facing the oven, which are equal in dimensions to one another, and each of which has the general form of a right-angle triangle. The forward edge of the base 4*a* is in integral attachment to a short wall 4*b* which inclines forwardly and upwardly away from the base 4*a*, and is at an obtuse angle to the base 4*a*. The sypoteneuse of the approximate right-angle triangle defined by each side wall 4*c* slopes upwardly and rearwardly from the forward portion of the main casing 1, and the lower, forward end thereof is truncated slightly, the lower, forward ends of the side walls 4*c* being in integral attachment to opposite ends of the short wall 4*b*. The rear edge of the base 4*a* is in fixed or integral attachment to a vertical plate 10 which separates the main casing 1 and heating assembly housing 3.

In fixed or integral attachment to the front edge of the short wall 4*b* and to the long sides of the side walls 4*c* there is provided a generally rectangular frame 6 which has comparatively broad borders and is inclined to the horizontal at the same angle as the long sides of the side walls 4*c*. The topmost border 6*a* of the frame 6 has a rear edge in fixed or integral attachment to a top portion of the front side of the heating assembly housing 3 and extends to a point which is a short distance forward of the plate 10, i.e., the topmost border 6*a* constitutes a free projection extending forwardly and downwardly into the upper rear portion of the main housing 1. At least the topmost border 6*a* of the frame 6 is made of a material suitable for reflection of microwaves. Generally in line with the front edge of the frame topmost border 6*a* there is provided a vertical partition 17 which is made of a material having low permittivity, is mounted on the base 4*a*, and extends crosswise between the side walls 4*c* and upwards to a short distance below the topmost border 6*a*. Thus the oven chamber lower portion 4 has the approximate shape of a right-angle prism defined by the main portion of the base 4*a*, short wall 4*b*, side walls 4*c* and partition 17, and has an upper opening which lies on an inclined plane and is surrounded by the frame 6. Within this lower portion 4, the base 4*a*, short wall 4*b* and the bottom portion of the partition 17 define a basin 4*d*. The rear portion of the base 4*a*, the partition 17, plate 10 and the frame topmost border 6*a* generally define stirrer mean housing portion 14*a* housing stirrer means or a fan 14, described below. It should be noted here that, since the surface of the frame 6 is inclined at an angle $\theta$ to the bottom plate 1*a* of the casing 1, the height $h$ of the oven chamber lower portion 4 increases toward the rear portion, i.e., toward the vertical plate 10, thus providing sufficient space for the lower portion 4.

As best shown in FIG. 2, in fixed or integral attachment to the upper outside edges of the frame 6 there are formed side frame walls 7 which are at right-angles to and extend outwards with respect to he frame 6. The frame 6 and side frame walls 7 together define a seating space 7*a* for the door assembly 2. Near the lower end of each left and right wall 7 there is formed a detent recess 7*b*, the recesses 7*b* being engageable by latches 2*b* provided on the door assembly 2. The main casing further comprises an interior portion which provides sliding accommodation for an arm 2*c* which is attached to a lower side portion of the door assembly 2 and passes through a portion of the frame 6. The door arm 2*c* may, of course, be attached to another portion of the door assembly 2 and pass through another portion of the main casing 1. The main casing 1 further comprises an outside front wall portion which is inclined upwards from front to rear of the main casing 1 at the same inclination as the frame 6, and on which there is mounted a control panel 9, carrying a timer 9*a* and start switch 9*b*, for example. The elements of the control panel 9 connect to and control elements of the heating assembly in the housing 3 in a known manner.

Still referring to FIGS. 1 through 3, the door assembly 2 has one edge portion connected by horizontally disposed hinges 2*a* to a top rear portion of the main casing 1, the door assembly being pivotal upwards or downwards to open or closed positions. The door arm 2 may be arranged to permit the door assembly 2 to be held in various positions of partial or full opening.

The door assembly 2 comprises a main rim 5a which has a double wall structure, defines a flat surface having dimensions equal to those of the frame 6, and has a thickness generally equal to the height of the side frame walls 7, thereby the rim 5*a* may fit exactly into the seating recess 7*a*. The abovementioned latches 2*b* extend from opposite sides of the rim 5*a*, and by engagement with the detent recesses 7*b* retain the rim 5*a* in the seating recess 7*a*, whereby the door assembly 2 may be kept closed. As noted earlier the borders of the frame 6 are comparatively broad and there is therefore a large area of contact between the rim 5*a* and frame 6, thus providing a good heat seal. As a microwave seal there is provided an attenuator coil or coils, or similar means, in the main cosing 1 portion adjacent to the seating recess 7*a*, or inside the rim 5*a*, which is broad enough to accommodate suitably large attenuator means. There is also preferably provided a switch element which is, for example, mounted in the seating recess 7*a* and actuated by the rim 5*a*, and is closed only when the rim 5*a* is completely seated in the seating recess 7*a*, and which forms part of the circuit controlled by the start switch 9*b* and must be closed before this circuit can be actuated, whereby heating of the oven can be effected only when the door assembly 2 is completely closed.

The rim 5*a* carries a concave structure, which is fixed or integral connection thereto, and comprises generally triangular side walls 5*d* and a generally rectangular front wall 5*b* and top wall 5*c*. The walls 5*b*, 5*c* and 5*d* together define a cavity which is generally triangular in section, and which, as best shown in FIG. 3, constitutes the upper portion 5 of the oven chamber when the door assembly 2 is closed, the oven chamber lower portion 4 and upper portion 5 together constituting a generally cubic space. Either the front wall 5*b* or the top wall 5*c*, or both, may be transparent or may have formed or mounted therein viewing windows to permit contents of the oven to be seen even when the door assembly 2 is closed. The door assembly 2 may be moved to open or closed positions by means of a handle 8 which is attached to the front edge of the rim 5*a*.

As illustrated most clearly in FIG. 2 and in the chain line portion of FIG. 3, when the door assembly 2 is raised to an open position, the oven chamber lower portion 4 is clearly exposed and food may be inserted vertically into the oven, which thus offers no inconvenience of operation even if placed on the floor, or, if the oven if at a comparatively high level, food may be inserted via the front of the oven. Since no extra side-to-side or front-to-rear space is required during opening or closing movement of the door assembly 2, the oven is utilizable in a space which is very little greater than the space occupied by the oven when the door assembly 2 is closed. It is also to be noted that when the door assembly 2 is in a most open position cleaning of the oven interior is extremly straightforward since the whole of the oven interior is visible and accessible.

Referring now to FIG. 4, there is shown a modification of the microwave oven of FIGS. 1 to 3. In this modification, the front wall 5*b* and the top wall 5*c* of the door assembly 2 are disposed at an angle close to a right angle to each other with the front wall 5*b* more inclined inward than that of FIG. 3 and are so arranged with respect to the rim 5*a* that when the door assembly 2 is closed the top wall 5*c* is horizontal and the front wall 5*b* slopes downwardly and forwardly to a less degree than that of FIG. 3. According to this modification, dimensions of the oven base 4*a* and top wall 5*c* are selected so that the junction B between the front wall 5*b* and top wall 5*c* is vertically above or forward of the junction C between the base 4*a* and short wall 4*b*, when the door assembly 2 is closed. The inside dimensions of the rim 5*a*, are selected so that the most rearward part A of the front side of the rim 5*a* is vertically above or forward of the junction C, and the locus of the point A passes outside the junction B upon opening of the door assembly 2. Thus if a comparatively tall object such as bottle 19 is placed in the oven, since the bottle 19 cannot be placed further forward than the junction C, there is no danger of the bottle 19 being knocked down by the front wall 5*b* or the part A of the rim 5*a* when the door assembly 2 is opened, which arrangement is very advantageous in actual use. FIG. 4 shows the limiting case wherein part A of the rim 5*a* and the junctions B and C are all in a straight, vertical line. However, as noted, the aims of the invention are met so long as part A or junction B are forward of, i.e., leftward in the drawing, of junction C.

It should be noted that, in the modification of FIG. 4, the top edge of the partition 17 is connected to the top rear edge of the frame 6, i.e., to the rear part of the under surface of the topmost border 6*a* by a shaped connector piece 17*a* which is made of a material having low permittivity similar to that of the partition plate 17 and which is formed with openings for air passage, and that such a shaped connector piece may be provided in the correspondng portion in the embodiment of FIG. 3.

Referring to FIG. 3 and FIG. 5, in the housing 3 there is mounted a magnetron 12 having an output loop 13. Microwave output of the magnetron 12 is fed by the loop 13 into a waveguide 11, which is provided in a generally central position in the upper portion of the housing 3, is disposed horizontally and generally in line with the topmost border 6*a* of the frame 6, and directs the microwave output into the upper rear portion of the main casing 1. A portion of the housing 3 defines an air duct 16 via which air to cool the magnetron 12 may pass, cooling air being driven through the duct 16 by an air motor 21 provided in the housing 3 near to the magnetron 12, as best shown in FIG. 5. Before exiting from the oven, cooling air must pass through the fan housing portion 14*a* defined between the plate 10, partition 17 and rear portion of the base 4*a*, entry of air into the fan housing portion 14*a* being permitted by suitably disposed holes formed in the upper portion of the plate 10. The fan 14 has blades made of a material suitable for reflection of microwaves, and is rotatably mounted on a shaft 15 which is horizontal and fixedly mounted to an approximately central point of the forward side of the plate 10. Air passing through the housing portion 14a causes the fan 14 to rotate, there thus being no necessity for provision of a separate fan motor. Power to the magnetron 12 is supplied by a high voltage transformer 24 which, as shown most clearly in FIG. 5, is provided in a rear corner of the housing 3, generally in line with the control panel 9. In this location the transformer 24 is as far as possible from the oven chamber portions 4 and 5, and so effects of leakage of magnetic flux from the transformer 24 on the walls of the chamber portions 4 and 5 are minimum, thus reducing vibration and noise during action of the oven.

Referring back to FIG. 3, paths of microwaves are illustrated schematically by dotted arrowed lines. When the oven door assembly 2 is closed and the start switch 9b is turned on, microwaves produced by the magnetron 12 and directed into the upper rear portion of the main casing 1 meet the under surface of the topmost border 6*a* of the frame 6 and are reflected thereby in a generally downward direction, most of the microwaves thus reflected being directed into the fan housing portion 14a, where they impinge on the fan 14. Simultaneously with start of actuation of the magnetron 12, the air motor 21 is started, and air passing through the duct 16 to cool the magnetron 12 also causes rotation of the fan 14, which therefore directs the microwaves in a disperse manner into the oven chamber. Since the front wall 5*b* and top wall 5*c* are at an obtuse angle to one another, any microwaves impinging thereon tend to be distributed in a generally downward direction after no more than one or two reflections and concentrated upon the object to be heated, thus causing efficient heating of an article of food 18 supported on the base 4*a*, which arrangement is one of the most outstanding features of the microwave oven of the invention. If the food in the oven is, for example, a liquid which may overflow upon being heated, any liquid which overflows is retained in the chamber basin 4*d*, and is prevented by the sloping short wall 4*b* from leaking between the rim 5*a* of the door assembly 2 and frame 6 of the main casing 1. Also, provision of the short wall 4*b* at an obtuse angle to the base 4*a* further facilitates cleaning of the oven interior.

As is clear from the foregoing descriptions, the microwave oven of the invention offers the advantages of compact and simple construction with efficient distribution of microwave energy into the heating chamber by the employment of special microwave reflecting means, safe and economical operation through perfect and enduring microwave sealing means, minimum space requirements and complete facility of use, even though placed at different levels, by the novel door arrangements. The provision of the fan for microwave dispersion without requiring any separate driving power source, together with utilization of the topmost border of the frame for microwave reflection is particularly effective for evenly distributing microwave energy throughout the oven chamber, and consequently for efficient heating of the object in the heating chamber.

Furthermore, by the arrangement that the rim of the door assembly defining the upper portion of the oven chamber fits into the flat contact against the correspondingly dimensioned border provided in the main casing around the open side of the lower chamber portion, the microwave sealing means can be readily incorporated in the vicinity of the flat contact portion therebetween with increased safety and durability. Additionally, if the most rearward part A of the front side of the rim of the door assembly is arranged to locate vertically above or forward of the junction C between the base and short wall, with the junction B between the top wall and front wall of the door assembly being also disposed vertically above or forward of the junction C, the locus of the part A passes outside around the junction B upon opening of the door, and a comparatively tall object can advantageously be placed in the heating chamber without danger of being knocked down when the door assembly is opened.

Although the present invention has been fully described by way of example with reference to the attached drawing, it is to be noted that various changes and modifications are apparent to those skilled in the art. Therefore, unless otherwise such changes and modifications depart from the scope of the present invention, they should be construed as included therein.

What is claimed is:

1. A microwave oven comprising main casing portion defining an oven base, lower portion of a heating chamber, and including at least one flat mating surface which is defined by borders of a frame member for said main casing portion and which is inclined at an acute angle with respect to said base, a door assembly portion which defines a heating chamber upper portion which is complementary to said lower portion and which cooperates therewith to define a complete heating chamber, said door assembly being movable to and held at a closed position wherein said door assembly portion seals said heating chamber, and defining at least one mating surface which comes into flat contact with said main casing mating surface when said door assembly portion is in said closed position, said door assembly being movable pivotally, upwardly to an open position, heating assembly including high frequency wave generation means, high frequency wave direction means for directing waves generated by said generation means into said main casing portion, and power supply means for supplying electrical power to said generation means, housing portion for housing said heating assembly.

2. A microwave oven as claimed in claim 1, wherein said high frequency wave direction means of said high frequency wave generation means faces an under surface of a topmost border of said frame member of high frequency waves reflecting material, in a position adjacent to the latter.

3. A microwave oven as claimed in claim 2, wherein there is further provided stirrer means of high frequency waves reflecting material, said stirrer means having a rotatory shaft member horizontally mounted in a rear portion of said main casing portion for rotation of said stirrer means said high frequency waves being reflected by said under face of said topmost border of said frame member and directed toward said stirrer means for further reflection into said heating chamber.

4. A microwave oven as claimed in claim 1, wherein said heating assembly housing is disposed at the rear of said main casing portion.

5. A microwave oven as claimed in claim 1, wherein said portion of said main casing portion defining a heating chamber is made of strongly magnetizable material, said heating assembly housing being provided at the rear of said main casing portion with high voltage transformer means of said power supply means being disposed in a rear corner portion of said heating assembly housing.

6. A microwave oven as claimed in claim 1, wherein said heating chamber upper portion includes a front wall which, when said door assembly portion is in said closed position, is sloped gently relative to a line normal to said base.

7. A microwave oven as claimed in claim 1, wherein said heating chamber lower portion has a forward end wall, inclined at an obtuse angle with respect to said base of said main casing portion.

8. A microwave oven as claimed in claim 1, wherein said heating chamber upper portion defined by said door assembly includes a top wall which is disposed in a direction approximately parallel to said base and a front wall which is disposed in a direction inclined forward relative to a line normal to said base when said door assembly portion is in said closed position, said heating chamber lower portion including said forward end wall which is inclined at the obtuse angle to said base and communicates with the forward end of said base and one border of said frame member defining said main casing mating surface, a first junction between said base and said forward end wall, a second junction between said top wall and said front wall, and the rearmost part of that portion of said door assembly portion mating surface which contacts said main casing portion mating surface adjacent to said forward end wall being in the vicinity of or forward of a line normal to said first junction when said door assembly portion is in said closed position.

* * * * *